US009351581B1

(12) United States Patent
Sawyer

(10) Patent No.: US 9,351,581 B1
(45) Date of Patent: May 31, 2016

(54) MISTING APPARATUS WITH ZONAL CONTROL

(71) Applicant: John C. Sawyer, Nashville, TN (US)

(72) Inventor: John C. Sawyer, Nashville, TN (US)

( * ) Notice: Subject to any disclaimer, the term of this patent is extended or adjusted under 35 U.S.C. 154(b) by 0 days.

(21) Appl. No.: 14/740,102

(22) Filed: Jun. 15, 2015

Related U.S. Application Data

(63) Continuation of application No. 14/051,330, filed on Oct. 10, 2013, now abandoned, which is a continuation-in-part of application No. 13/673,753, filed on Nov. 9, 2012, now abandoned.

(60) Provisional application No. 61/558,488, filed on Nov. 11, 2011.

(51) Int. Cl.

| | |
|---|---|
| ***A47C 7/74*** | (2006.01) |
| ***B05B 1/16*** | (2006.01) |
| ***A47C 1/14*** | (2006.01) |

(52) U.S. Cl.
CPC ..... *A47C 7/744* (2013.01); *A47C 1/143* (2013.01); *B05B 1/169* (2013.01)

(58) Field of Classification Search
CPC ..... B05B 1/16; B05B 1/169; B05B 1/185; B05B 1/20; B05B 15/063; B05B 15/1203; A47C 7/742; A47C 7/744
See application file for complete search history.

(56) References Cited

U.S. PATENT DOCUMENTS

| | | | | | |
|---|---|---|---|---|---|
| 4,468,822 | A * | 9/1984 | McKay | A61H 33/025 | 4/488 |
| 4,961,535 | A * | 10/1990 | Skibik | A47C 1/14 | 239/279 |
| 5,613,731 | A * | 3/1997 | Aspinall | A47C 1/14 | 239/289 |
| 5,820,472 | A * | 10/1998 | Briggs | A63B 9/00 | 472/128 |
| 5,823,617 | A * | 10/1998 | Schafer | A47C 1/143 | 239/289 |
| 6,592,049 | B1 * | 7/2003 | Wolput | B05B 1/202 | 239/211 |
| 7,252,329 | B1 * | 8/2007 | O'Meally | A47C 1/143 | 297/180.15 |
| 8,123,291 | B1 * | 2/2012 | Hernandez | A47C 1/143 | 297/180.15 |

* cited by examiner

*Primary Examiner* — Ryan Reis
(74) *Attorney, Agent, or Firm* — Shane V. Cortesi

(57) ABSTRACT

An apparatus for providing mist to a user, where the apparatus has multiple misting nozzles grouped into zones of one or more misting nozzles. The misting nozzles are supplied water from a supply line, and valves controlling the flow of water through the supply line and to the misting nozzles of each zone.

9 Claims, 10 Drawing Sheets

MISTING APPARATUS WITH ZONAL CONTROL

RELATED APPLICATIONS

This application is a continuation of U.S. nonprovisional application Ser. No. 14/051,330, filed Oct. 10, 2013, which is a continuation-in-part application claiming priority to U.S. nonprovisional application Ser. No. 13/673,753, filed on Nov. 9, 2012, which claims priority to U.S. provisional patent application Ser. No. 61/558,488 for "Misting Apparatus with Zonal and Intensity Control," filed Nov. 11, 2011. The contents of U.S. nonprovisional application Ser. No. 14/051,330 are incorporated herein by reference in their entirety.

BACKGROUND

1. Technical Field

This invention relates generally to recreational and relaxation misting devices.

2. Background of the Invention

Water sprayed in the form of a mist provides cooling and relaxation on warm days and can provide recreational activity for children to play in water. Alternatively, providing a warm-water mist in cool weather increases the ambient temperature in a particular area where the mist is provided. Further, because mist is provided as atomized water droplets, mist has an advantage over other forms of dispensing water for multiple reasons. It provides a light moisturizing and humidifying effect over a general area, as opposed to a spray, jet, or squirt of water directed to a specific point. Furthermore, directed sprays, jets, or squirts of water often cause water to pool on the ground and form mud or disrupt landscaping, whereas a gentle mist over a dispersed area minimizes such disadvantageous effects.

What is needed, then, is an apparatus capable of delivering mist to specific areas as desired by the user, where misting nozzles are controllable by the user to mist particular desired areas while not misting others.

BRIEF SUMMARY

In some aspects, the invention relates to an apparatus for providing mist to a user that has a closed hollow loop, a water port that allows water into the hollow loop, multiple misting nozzles arranged about the exterior of the loop, and multiple valves that each control the flow of water to at least one misting nozzle.

In other aspects, the invention relates to an apparatus for providing mist to a user as a pad, multiple misting nozzles set into the top surface of the pad and grouped into zones, each zone comprising at least one misting nozzle, a supply line configured to supply water to the misting nozzles, and multiple valves that each control the flow of water through the supply line to misting nozzles in a zone.

In other aspects, the invention relates to an apparatus for providing mist to a user as a chair with one or more frames and a backing material, a water port for receiving water into the frames, multiple misting nozzles set into the frames and grouped into a plurality of zones, each zone having at least one misting nozzle, and multiple valves that each control the flow of water to misting nozzles in each zone.

In other aspects, the invention relates to an apparatus for providing mist to a user as a chair with one or more frames and backing material, multiple misting nozzles set into the chair and grouped into a plurality of zones, each zone having at least one misting nozzle, a supply line that supplies water to misting nozzles in each zone, and multiple valves that each control the flow of water through the supply line to misting nozzles in each zone.

In other aspects, the invention relates to an apparatus for providing mist to a user, the apparatus having multiple misting tubes, each misting tube having open ends and having at least one misting nozzle embedded in the outer surface of the tube, and a valve that controls the flow of water to the misting nozzles; multiple joints with a plurality of apertures that each engages an end of a misting tube; and a water intake member comprising a water port that receives water and an end that engages either a joint aperture or a misting tube.

Other aspects and advantages of the invention will be apparent from the following description and the appended claims.

BRIEF DESCRIPTION OF THE DRAWINGS

It should be noted that identical features in different drawings are shown with the same reference numeral.

DETAILED DESCRIPTION

Figure 1:
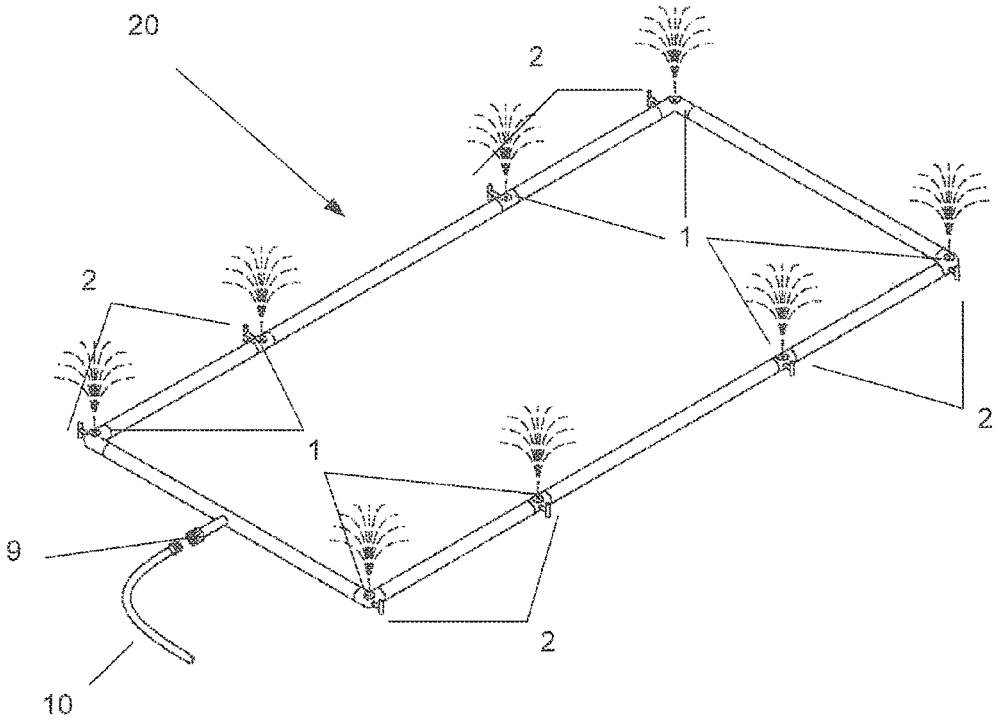
FIG. 1 shows a perspective view of a misting loop in accordance with one embodiment of the present invention.

FIG. 1 depicts one embodiment of the invention, in which the apparatus is a hollow closed loop 20 with multiple misting nozzles 1 distributed about the circumference of the loop 20. The loop 20 may be a closed band or tube having a hollow interior allowing water to pass through. The loop 20 may be constructed of either flexible or inflexible material and forms a closed loop enclosing an area of any shape. For example, although FIG. 1 depicts the loop 20 in a rectangular embodiment, the loop 20 may be circular, square, triangular, or any other shape preferred by the user. The loop 20 may also lay flat on a flat surface (not shown), or it may be curved or arched to have a saddle-like shape, or any other shape whereby sections of the loop 20 are raised off the ground. The loop 20 can be made of any material that is not reactive with water, such as treated wood, flexible foam, hard plastic, soft plastic, nylon, or any inflatable material.

Each misting nozzle 1 is embedded directly in the outer surface of the loop 20 and extends at least into the hollow interior to be in fluid communication with the supply of water. A misting nozzle 1 is a nozzle adapted to spray mist produced by forcing pressurized water through a small hole or set of holes. Misting nozzles 1 may be made of any hard material suitable for maintaining a flow of water through a constricted flow area over a period of time without degradation or oxidation, such as brass, stainless steel, a hard plastic such as polypropylene, or nylon. A user or manufacturer may orient the misting nozzles 1 to spray mist either into the area enclosed by the loop 20 or areas not enclosed by the loop 20.

A water source 10 introduces water into the hollow interior of the loop 20. The water source 10 may be a garden hose, a pressurized water tank, or any other source of pressurized water. The water source 10 connects to a water port 9 which receives the water from the water source 10 and conducts the water into the hollow interior. The water port 9 may extend beyond the body of the loop 20, or it may be flush with the outer surface of the loop 20, such that only the open terminal of the water port 9 is visible. The water port and water source are further described below.

Figure 2:
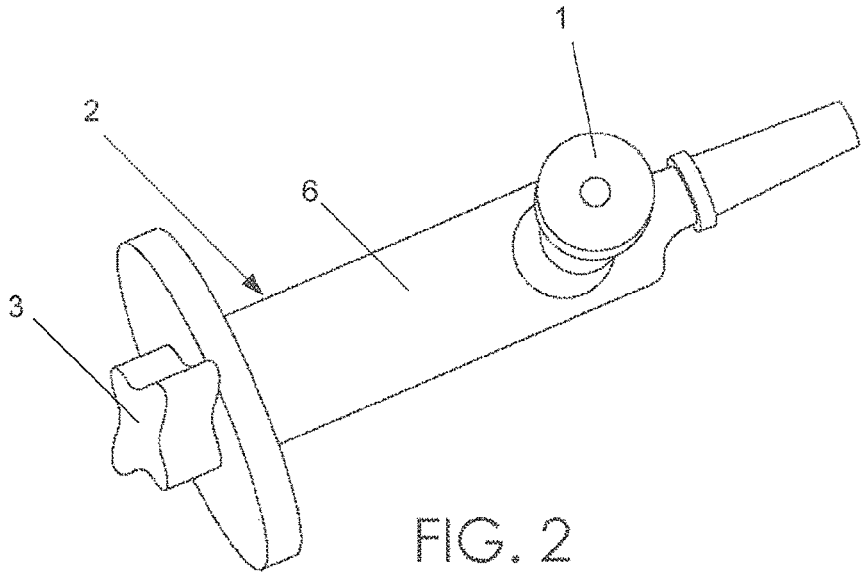
FIG. 2 shows a perspective view of a valve in fluid connection with a misting nozzle in one embodiment of the present invention.
Figure 3:
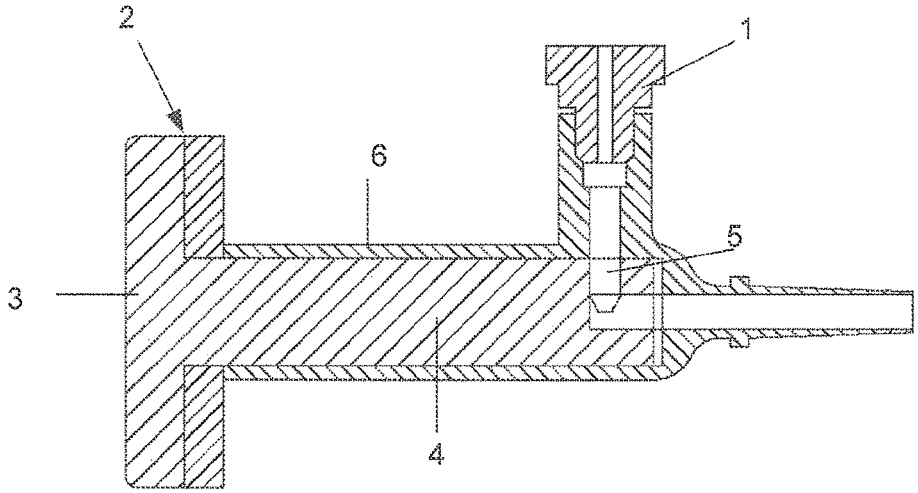
FIG. 3 shows a side elevation view depicting the interior of the valve in accordance with one embodiment of the present invention.

Valves 2 control the flow of mist through the misting nozzles 1. Each valve 2 may be operable by the user to control one or more misting nozzles 1. In some embodiments, as depicted in FIGS. 2 and 3, the valve 2 has a cylindrical spool 4, which may be sealed within the body 6 of the valve by one or more 0-rings to prevent water leakage. The spool 4 has an aperture 5 bored or formed through the side walls. In the open position, the aperture 5 allows water to flow to the misting nozzle 1. In the closed position, the spool 4 blocks water from flowing to the misting nozzle 1. One end of the spool 4 attaches to or may be formed together with a valve head 3. To open or close the flow of water to the misting nozzle 1, the user rotates the valve head 3 in the appropriate direction. Rotating the valve head 3 also rotates the spool 4, such that the aperture 5 rotates from the open position to the closed position, or vice versa. In some embodiments, the misting nozzle 1 extends out from the side of the valve spool 4 at roughly a ninety degree angle.

Figure 4:
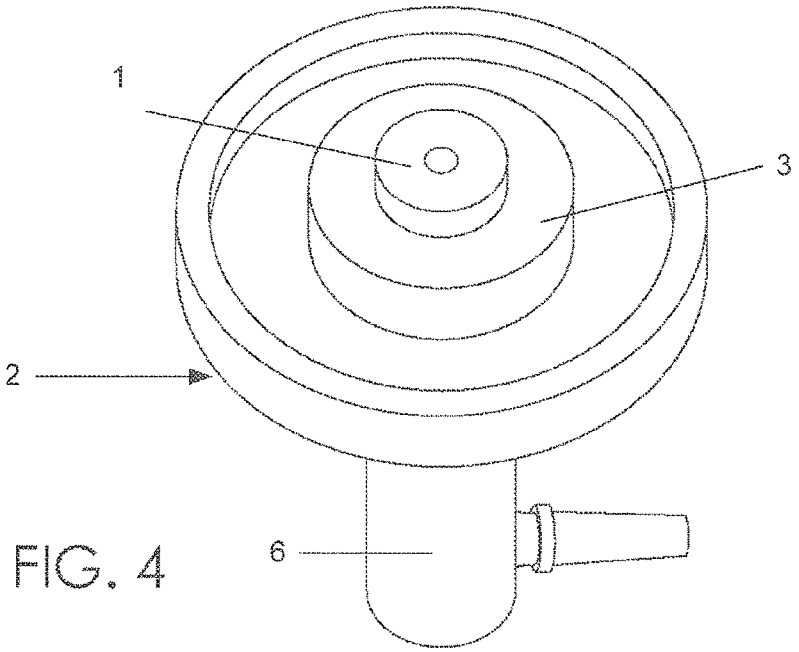
FIG. 4 shows a perspective view of a valve with a misting nozzle integrated into the head of the valve in accordance with one embodiment of the present invention.
Figure 5:
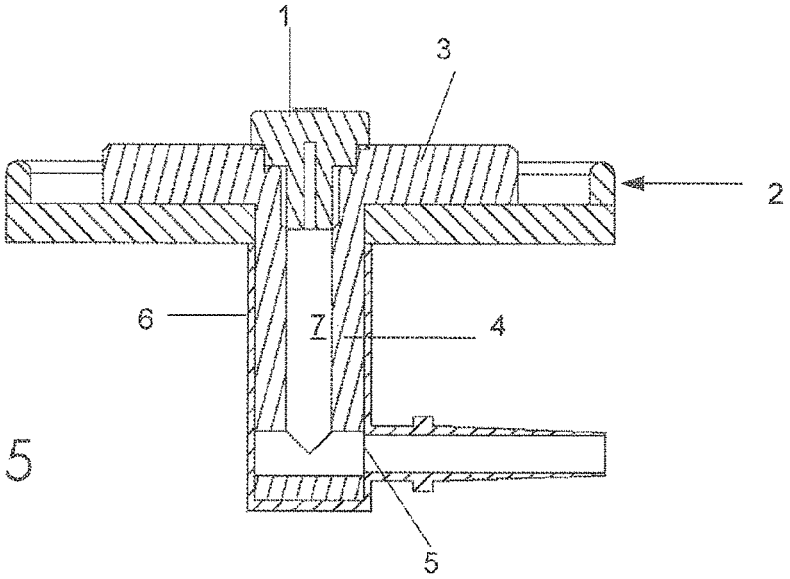
FIG. 5 shows a side elevation view of a valve with a misting nozzle integrated into the head of the valve in accordance with one embodiment of the present invention.

In other embodiments, the misting nozzle 1 may be integrated within the valve head 3, as depicted in FIGS. 4 and 5. In such embodiments, the valve spool. 4 and head 3 have a central bore 7 in fluid connection with an aperture 5 passing laterally through the spool 4. The central bore 7 allows water to flow to a misting nozzle 1 seated within the valve head 3. When user desires to turn on or off the water flow, the user turns the valve head 3. The connected spool 4 and aperture 5 are also rotated thereby, such that the water flows to the central bore 7 as the misting nozzle 1 is opened or closed, as desired.

Other types of commonly used valves (such as a globe valve, gate valve, or ball valve) operable to turn on, shut off, or vary the flow rate of water to one or more misting nozzles 1 may also be used without departing from the scope of this disclosure.

Returning to FIG. 1, in some embodiments, a valve 2 governs water flow into a single misting nozzle 1 without interrupting the flow of water through the hollow interior. The spool 4 of the valve 1 only governs water flow through the mister 1, rather than restricting the flow of water through the hollow interior. This allows each misting nozzle 1 to be individually controlled.

In other embodiments, the misting nozzles 1 are grouped into multiple zones, with each zone being a partial section of the loop 20. One or more valves 2 may intercept the hollow interior to control the flow of mist through each zone. For example, two valves 2 may be located halfway around the loop 20, with the water port 9 receiving water into one half of the loop 20. The user may shut off both valves 2 to allow mist to spray only from the misting nozzles 1 in the zone of the loop 20 having the water port 9. If the user desires mist to spray from the other zone, the user may open one or both valves 2.

In some embodiments, the loop 20 may be a unitary construction. In other embodiments, the loop may be formed of one or more loop members (not shown), which may be joined together to form the loop 20. Each member has a hollow interior bored out and two ends. Each end is adapted to connect to another member such that water may flow through the hollow interiors from one member to the next. Each member also has at least one misting nozzle 1 controlled by at least one valve 2. For example, in a rectangular-shaped loop 20, each side of the loop 20 may form a loop member which is detachable from the other members. Alternatively, each member of a rectangular loop 20 may be of roughly equal length, with two or more members forming the long sides of the rectangle and one member forming the short sides. In some embodiments, a user may join the loop members with a joint (not shown) adapted to receive the end of two loop members without leaking, such as by using fitted joints or an O-ring. In other embodiments a valve 2 intercepts the hollow interior of each loop member to govern the flow of water. In other embodiments, a valve 2 may be integrated into each joint to govern the flow of water from one loop section to another.

Figure 6:
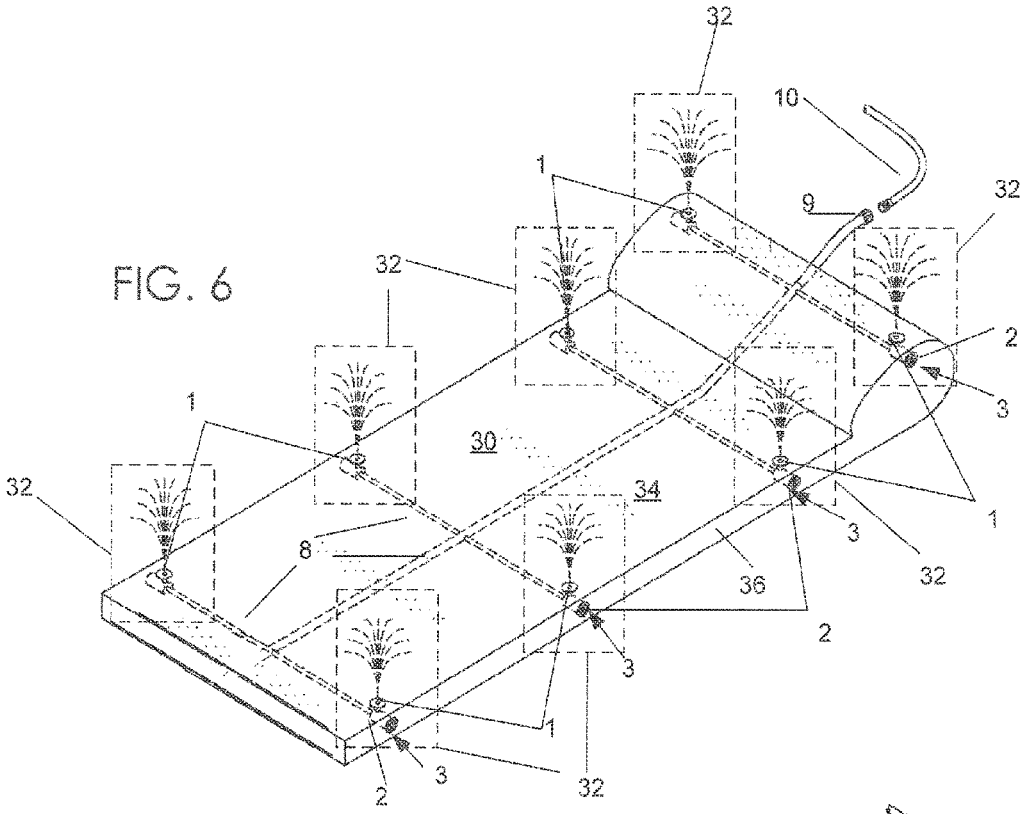
FIG. 6 shows a perspective view of the top of a misting pad with embedded supply lines, in accordance with one embodiment of the present invention.
Figure 7:
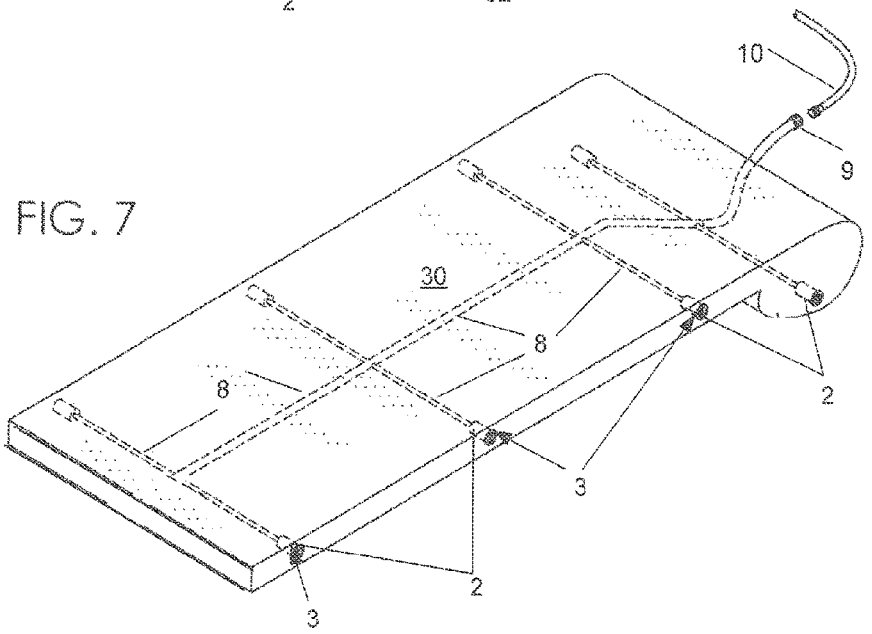
FIG. 7 shows a perspective view of the bottom of the misting pad in accordance with one embodiment of the present invention.

In another embodiment, with reference to FIGS. 6-7, the apparatus is a pad 30 with multiple misting nozzles 1 embedded on the surface of the pad 30 to provide sprays of mist. The pad 30 can be made of any material, such as treated wood, hard or flexible foam, hard plastic, soft plastic, nylon, or any inflatable material. The pad 30 may be constructed of a buoyant material to allow the pad to float in water and support a person, such as in a pool or lake. In some embodiments, the pad additionally has a removable cover made of any suitable material such as cloth, rubber, plastic, or canvas, which may or may not be water resistant. The pad 30 may also have a head rest, in any form as is commonly known and used in the art. In some embodiments, the pad 30 may be of a size to fit on a pool chair or lounge.

The misting nozzles 1 are arranged on the top surface 34 of the pad 30 and generally dispersed along the length of the pad 30. In one embodiment, the misting nozzles 1 are uniformly distributed along the length of the top surface 34, near the edge 36 of the pad 30. The misting nozzles 1 are grouped into at least two zones 32, such that each zone 32 has at least one misting nozzle 1. The misting nozzles 1 in each zone 32 are configured to spray mist over a particular area of the pad 30. In this manner, each zone 32 of the pad 30 is substantially covered by an independent set of one or more misting nozzles 1. For example, a pad 30 may be characterized by six zones 32 of one or more misting nozzles 1 in each zone 32, where the misting nozzles 1 in each zone 32 are independently directed to spray mist in substantially the upper left, upper right, middle left, middle right, lower left, and lower right areas of the pad 30, respectively.

A supply line 8 embedded within the body of the pad 30 provides water to the misting nozzles 1 from a water source 10, such as a common garden hose. The water source 10 may be a source of water under a pressure similar to that of a standard outdoor water faucet and hose. The supply line 8 can be made of any material suitable for a tube, hose, or pipe. If the pad 30 is made of a flexible material, then preferably the supply line 8 is also made of a flexible material (such as rubber, a flexible plastic, or nylon) to allow great flexibility to the entire pad 30, though this is not required. In some embodiments, the supply line 8 has a structure of multiple branches splitting off from a central line, such that each branch provides a water supply to a particular zone of misting nozzles 1. At its terminus the supply line 8 has a water port 9 to detachably connect with the water source 10. This can be by any method known in the art for sealingly connecting fluid transmission lines. For example, if the water source 10 is a common garden hose, a threaded screw-on connector may be used as the water port 9 for the supply line 8. In some embodiments, the supply line 8 extends beyond the body of the pad 30 like a "tail." In such an embodiment, the supply line 8 may extend out from any side of the pad 30, at any position. In other embodiments, the water port 9 may be flush with the surface of the pad 30, such that only the open terminal of the water port 9 is externally visible.

The flow of water through the misting nozzles 1 of each zone 32 in the pad 30 may be controllable by the user, such that the flow of water can be turned on or shut off through a given zone 32 independently of the flow of water through the other zones 32. The water flow through a particular zone 32 is controlled by a valve 2 operated by the user to control the flow of water in the zone 32. Any valve 2 operable to control the flow of water, including those described with reference to FIGS. 2-5 above, may be used. The user may operate the valve 2 to vary or completely shut off the flow of water in a given zone 32. A valve 2 may be positioned at any location along a supply line 8 that allows the valve 2 to regulate the water provided to its zone 32. In some embodiments, the valve 2 may be positioned along the side edge 36 of the pad 30. In other embodiments, the valves 2 are grouped together near where a reclining user's hands would lay on the pad 30 when extended at rest. The valve head 3 may be accessible to the user from the side edge 36 or the top surface 34 of the pad 30, and the valve head 3 is rotated to open or close the spool 4 to govern the flow of water to the one or more misting nozzles 1 in the particular zone 32. In some embodiments in which a zone 32 has a single misting nozzle 1, the misting nozzle 1 may be embedded within the valve head 3, as depicted in and discussed with reference to FIGS. 4-5 above.

In some embodiments, the pad 30 is either self-inflating or inflatable. For a self-inflating pad 30, the pad 30 may be formed of expanding foam and has an air valve (not shown) that, when opened, allows air to enter the foam interior and expand. When a user desires to store away the pad 30, the user may compress the pad 30 and close the air valve to prevent reinflation. In inflatable embodiments, the pad 30 is constructed of a flexible skin of any suitable material with interior air pockets or chambers (not shown) that can be inflated manually or with an air pump. For these embodiments, the supply line 8 passes under the flexible skin or within the interior air pockets or chambers, and the misting nozzles 1 and valves 2 pass through to the exterior. A plastic seal, as is common in the art for sealing inflatable plastic devices, surrounds the misting nozzle 1 or valve head 3 to seal the pad 30.

In some embodiments, multiple supply lines 8 may provide water, where each supply line 8 supplies water to at least one unique zone. Each supply line 8 has a separate water port 9 attached to its end, and each supply line 8 may extend beyond the body of the pad 30 like a "tail." In such an embodiment, the multiple supply lines 8 extending from the pad 30 may individually connect at the water ports 9 to independent and unique water sources 10. Alternatively the multiple supply lines 8 extending from the pad 30 may each connect at the water ports 9 to an outlet end of a single reducing valve (not shown), which has a single inlet and multiple outlets. The reducing valve may be then connected to a single external supply line (not shown), which may be connected to a single water source 10.

Figure 8:
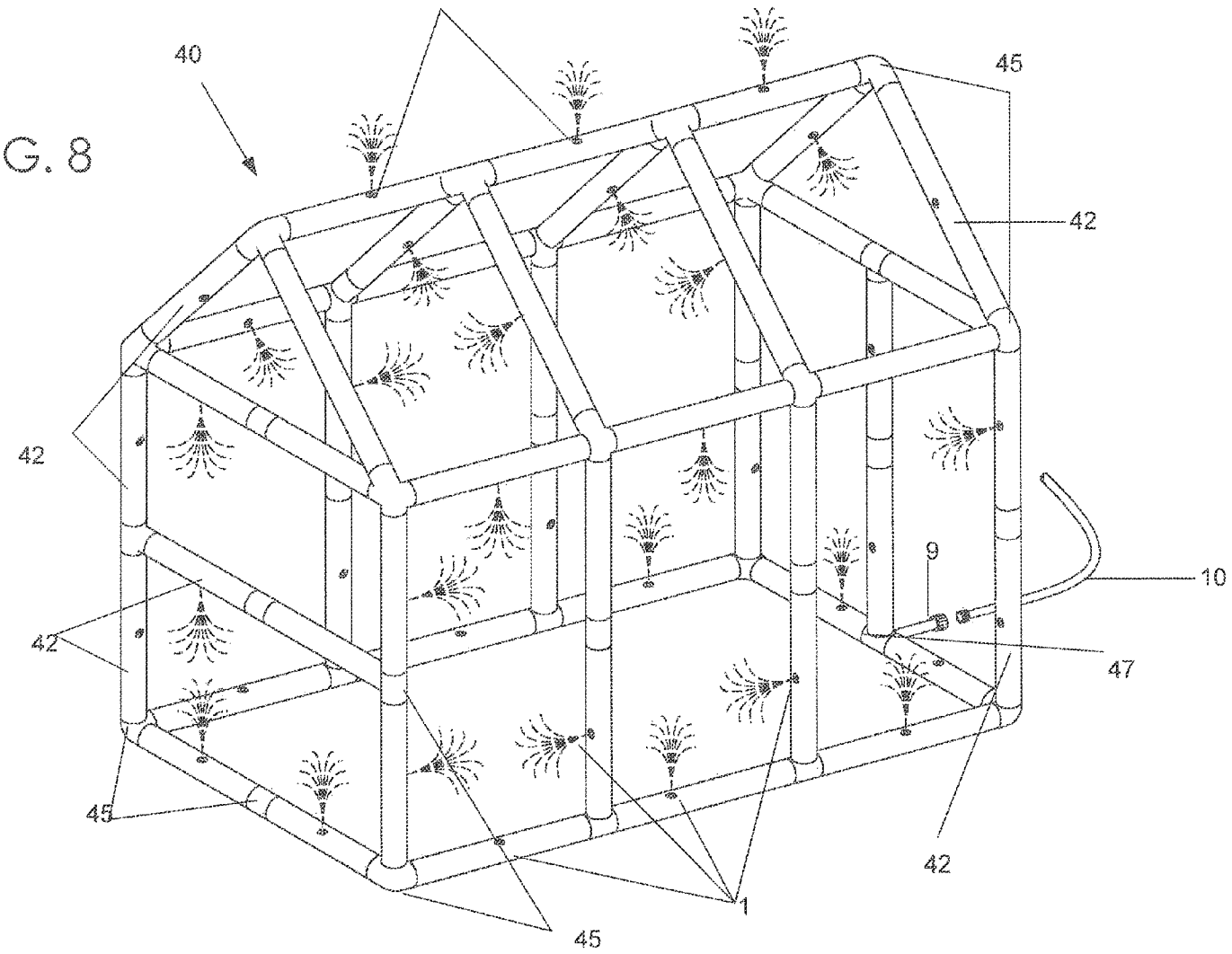
FIG. 8 shows a perspective view of the misting playset in accordance with one embodiment of the present invention.

As depicted in FIG. 8, in another embodiment, the apparatus may be a misting construction set 40 having multiple misting tubes 42, multiple joints 45, and at least one water intake member 47. The multiple misting tubes 42 are of a size suitable for a child over the age of three to handle, ranging in length from about one to three feet. Each tube 42 is open-ended, capable of transporting water through an interior bore, and has at least one misting nozzle 1 embedded along its outer surface. The tubes 42 may be constructed of nylon, aluminum, hard plastic, or any other material suitable for bearing water while substantially maintaining its structural shape. Each individual tube 42 may be straight, curved, twisted, bent, or arched. The end 44 of each tube 42 is adapted to detachably connect to a joint 45, as further described with reference to FIG. 9 below.

At least one misting nozzle 1 is embedded on the outer surface 43 of the tube 42 and extends into the inner bore of the tube 42 where water is transported. The misting nozzles 1 on each tube 42 are controlled by a valve 2, such as those described with reference to FIGS. 2-5 above, in order to allow the user to control the transport of water to the misting nozzles 1 on the tube 42. If a tube 42 has only one misting nozzle 1, the misting nozzle 1 may be embedded within the head 3 of a valve 2, as discussed with reference to FIGS. 4-5 above.

The joints 45 are adapted to detachably connect two or more tubes 42, such that water passes from one tube 42 through the joint 45 to other connected tubes 42. To accomplish this, each joint 45 has a hollow body having multiple apertures 46 adapted to detachably connect to the open ends 44 of the tubes 42. The apertures 46 may face outward from the hollow body of the joint 45 in any direction. The connection between the joint 45 and the ends 44 of each tube 42 may be accomplished by any of a number of methods to allow pressurized water to pass through without the joint 45 and tube 42 disconnecting, such as by being threaded and screwed together, or being snapped together by interlocking ridges and slots, or frictionally fitting the end 44 of a tube with the aperture 46 of the joint 45.

Figure 9:
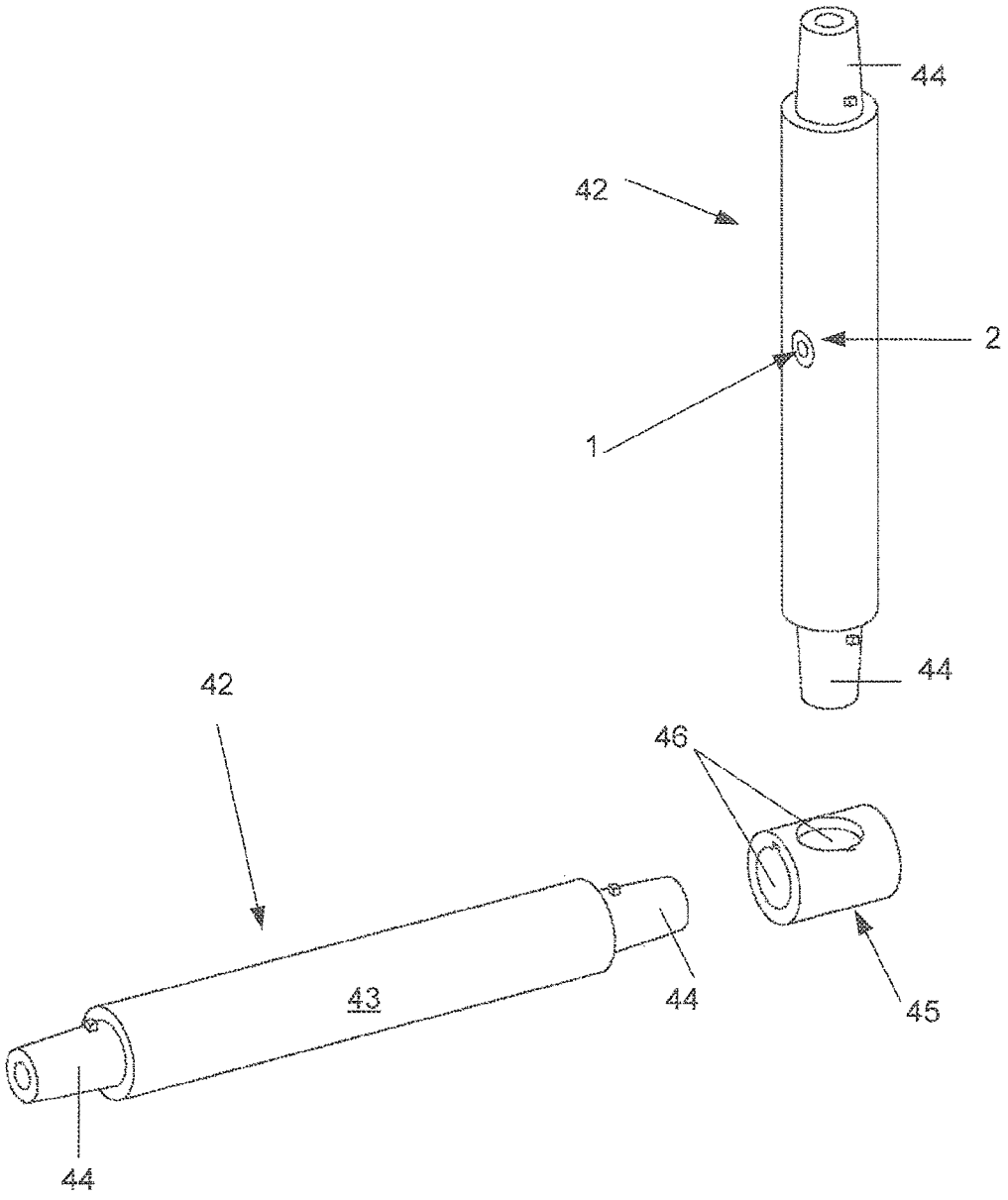
FIG. 9 shows an exploded view of the misting links and joints forming the misting playset in accordance with one embodiment of the present invention.

FIG. 9 depicts one method for connecting a tube 42 to a joint 45. The end 44 of each tube 42 may be tapered to engage the aperture 46. In the tapered section is a tab that aligns with and engages a groove along the edge of the aperture 46. To engage the end 44 and the aperture 46, the user aligns the tab with the groove, inserts the end 44 into the aperture 46, and twists the tube 42 relative to the joint 45 to lock the tube 42 and joint 45 into place.

Returning to FIG. 8, a water intake member 47 has a water port 9 connectable to a water source 10. The water intake member 47 may be adapted to supply water to one or more tubes 42 or joints 45. For example, as depicted in FIG. 8, the water intake member 47 may be fashioned as a joint 45 having the water port 9 in addition to multiple apertures for connecting to tubes 42. Alternatively, the water intake member 47 may be fashioned as a tube 42 with the water port 9 adapted within the body or at the end of the water intake member 47. The water intake member 47 may also have at least one open end connectable to a joint 45. In any embodiment, the water intake member 47 conducts water from the water source 10 to the assembled set of tubes 42 and joints 45.

As depicted in FIG. 8, the assembled misting construction set 40 provides users a misting device that can be assembled and dissembled to provide a recreational or relaxing mist for people or animals. To assemble the misting construction set 40, the user connects the tubes 42 and joints 45 to the water intake member 47 in shapes and forms as desired by the user, such that water can pass through the water intake member 47 to the tubes 42 and joints 45 to provide water to the misting nozzles 1 embedded in the tubes 42. In FIG. 8, for example, the misting construction set 40 has the appearance of a house. When constructed, it is not necessary that all apertures 46 in a particular joint 45 be connected to a tube 42. To prevent water from flowing out of an unconnected joint aperture 46, the joint 45 may be plugged by any of several methods known in the art. In one embodiment this may be accomplished by adapting the apertures 46 to have a spring loaded, depressable internal plug (not shown) that closes the aperture 46 when no tube 42 is connected, but when connected to a tube 42 the plug is depressed by the tube 42 to open and permit water flow. Alternatively, an external cap (not shown) may be used to seal an unconnected aperture 46.

Figure 10:
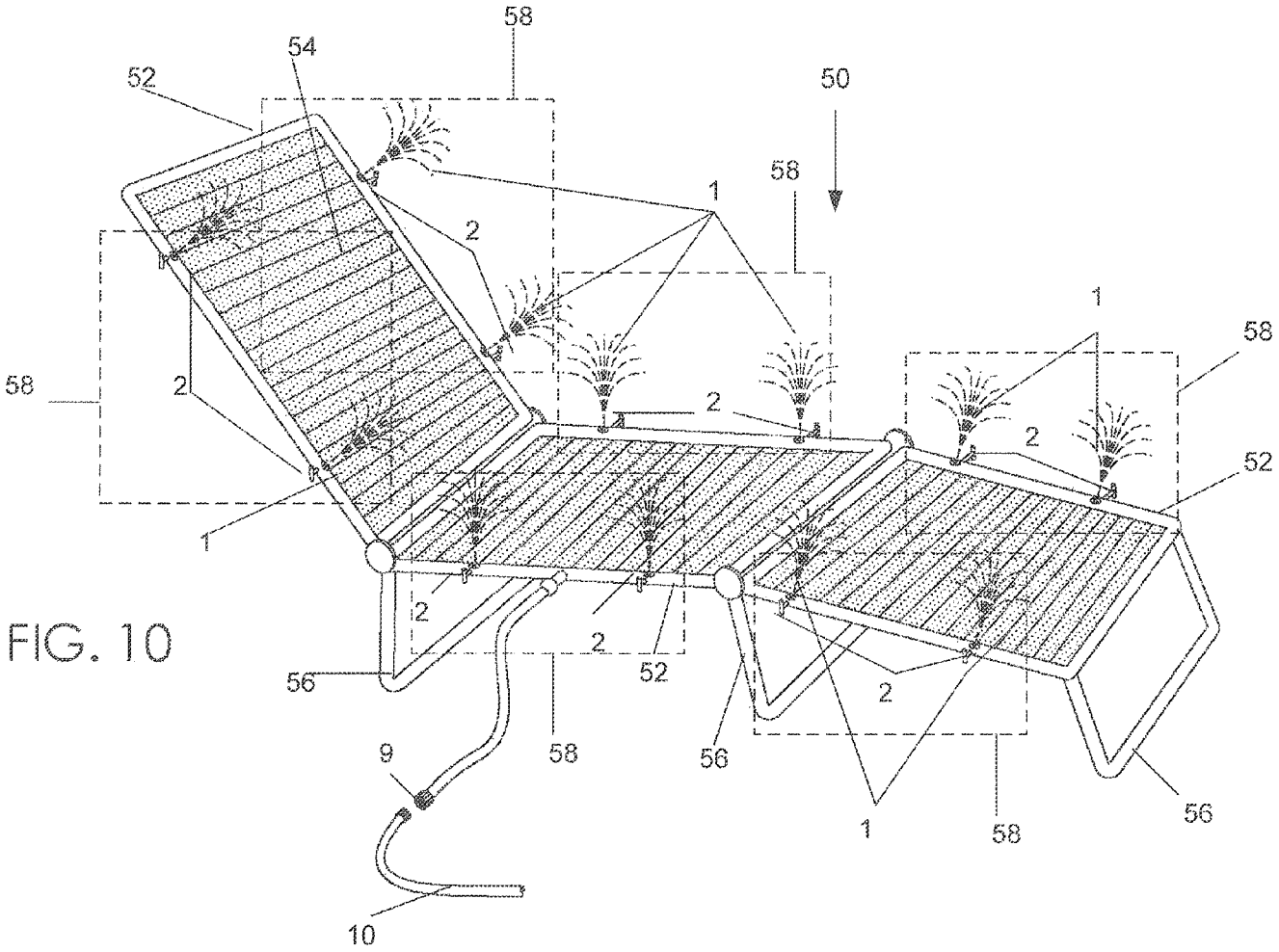
FIG. 10 shows a perspective view of a misting chair in accordance with one embodiment of the invention.

As depicted in FIG. 10, in another embodiment of the invention, the apparatus is a folding poolside or patio-type lounge 50 having misting nozzles 1 grouped into zones 58 controllable by the user. The lounge 50 has metal or plastic rectangular frames 52 linked one to another by hinges, such that the lounge 50 has an upper frame 52 typically for a user's head and upper body, a middle frame 52 typically for a user's hips and abdomen, and a lower frame 52 typically for a user's legs and feet. A backing material 54, such as plastic, fabric, cloth, nylon weave, or any other suitable material, may be stretched tightly across each frame to support the user's body. The lounge legs 56 may also be attached to the hinge, such that they can be folded underneath the frames 52 to facilitate portability. Additionally, in some embodiments the frames 52 may also be foldable to facilitate portability.

The lounge 50 has misting nozzles 1 attached to or embedded within the frames 52 and generally dispersed around the perimeter of the lounge 50. The misting nozzles 1 are arranged on the top surface of the frames 52. In one embodiment, the misting nozzles 1 are uniformly distributed around the perimeter of the lounge 50. The misting nozzles 1 are grouped into at least two zones 58, such that each zone 58 has at least one misting nozzle 1. The misting nozzles 1 in each zone 58 are configured to spray mist over or in the vicinity of the lounge 50 defined by the zone 58. In this manner, each zone 58 of the lounge 50 is covered by an independent set of one or more misting nozzles 1. For example, a lounge 50 may be characterized by three zones 58 of one or more misting nozzles 1 in each zone 58, where the misting nozzles 1 in each zone 58 are independently directed to spray mist substantially over the upper, middle, and lower frames 52, respectively. The misting nozzles 1 are supplied water from a supply line 8. The supply line 8 has a water port 9 attachable to a water source 10 that provides water. In some embodiments, the supply line 8 may be embedded within the frame 52. In other embodiments, the supply line 8 may pass along the outside of the frames 52 or be embedded within the backing material 54. Exemplary embodiments of the supply line 8 are further described with reference to FIGS. 11 and 12 below.

A user can control the flow rate of water through the misting nozzles 1 of each zone 58 by a valve 2, such that the flow of water can be turned on or shut off through a given zone 58 independently of the flow of water through the other zones 58. Each valve 2 is in fluid connection with the supply line 8 and may be physically attached to the frame 52. The valve 2 may be located along the supply line 8 to regulate the water flow provided to the zone 58 that it governs. Any valve 2 operable to control the flow of water, including those described with reference to FIGS. 2-5 above, may be used. In embodiments in which a zone 58 has a single misting nozzle 1, the misting nozzle 1 may be embedded within the valve head 3, as depicted in and discussed with reference to FIGS. 4-5 above.

Figure 11:
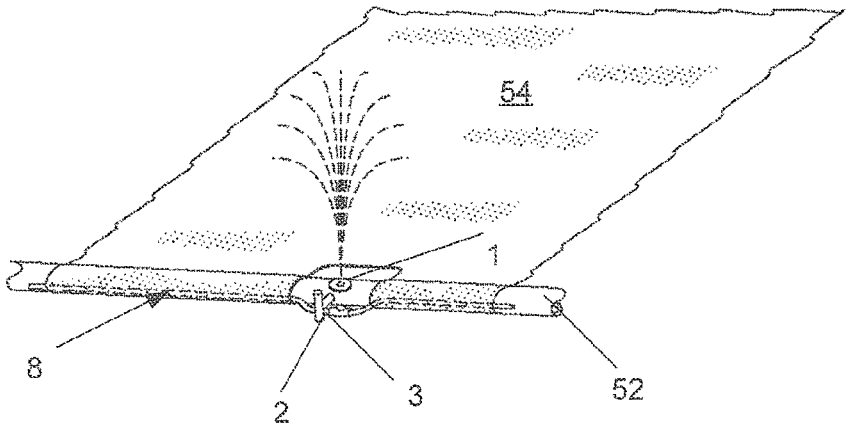
FIG. 11 shows a close-up view of the supply line passing within the fabric along the frame of the misting chair, in accordance with one embodiment of the present invention.

FIG. 11 depicts how the supply line 8 passes within or through a pocket formed in the backing material 54 to supply water to each misting nozzle 1. As depicted, the supply line 8 passes between the outside of the frame 52 and a pocket 62 formed by the backing material 54 wrapping around the frame 52. Alternatively, the pocket 62 may be sewn into the backing material 54 apart from the frame 52. A misting nozzle 1 may be located along the top of the frame 52. To fluidly connect the misting nozzle 1 with the supply line 8, an aperture may be bored through the frame 52 and a branch of the supply line 8 splits off to supply water to the misting nozzle 1. If this is the sole misting nozzle 1 in the zone 58, the misting nozzle 1 may be integrated into a valve head 3, as discussed with reference to FIGS. 4-5 above. In other embodiments, the supply line 8 may be embedded within the frame 52.

Figure 12:
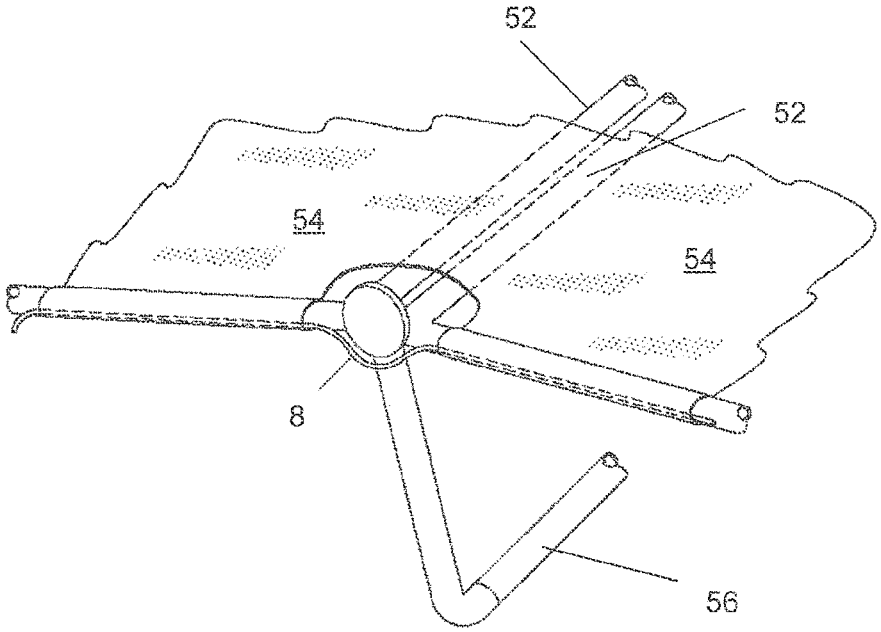
FIG. 12 shows a close-up view of a joint on the misting chair with the supply line passing through the fabric around the joint in accordance with one embodiment of the present invention.

FIG. 12 depicts the supply line 8 passing around the joint where the legs 56 support the frames 52. In some embodiments, the joints prevent a supply line 8 that is embedded within the frame 52 from passing from one frame 52 to the next. In such embodiments, the supply line 8 must exit the frame 52 and circumvent the joint. As depicted in FIG. 12, in one embodiment the supply line 8 passes out of sight within or along the underside of the backing material 54. In this manner, a single supply line 8 can supply all the zones 58 on the lounge 50.

The supply line 8 connects to a water port 9 that connects to a water source 10. In some embodiments, a water filter (not shown) may be attached or inserted inline between the water port 9 and the water source 10. The water filter cleanses the water of any impurities that may tend to clog the misting nozzles 1 over periods of extended use. The water filter may be disposable in nature and may be replaced periodically as needed. Optionally, a master valve (not shown) can be attached to the water port 9 to control the flow of all water into the supply line 8. If the master valve is attached directly to the water port 9, then the water filter may be attached or inserted inline between the water source 10 and the master valve. A person of skill in the art will recognize that the optional water filter and master valve may be used in conjunction with any of the embodiments disclosed within.

In other embodiments, the misting nozzles 1 of each zone 58 may be supplied by independent supply lines 8 in the chair. This may be used where each zone 58 coincides with a frame 52. In such embodiment, the water port 9 on each supply line 8 may each connect to an outlet end of a single reducing valve (not shown), which has a single inlet and multiple outlets. The reducing valve may be then connected to a single external supply line (not shown), which may be then connected to the water source 10 (and optionally, the water filter). Valves 2 control the flow of water through each supply line 8. A master valve in fluid connection with the external supply line could be used to control the flow of water into all the supply lines 8.

In some embodiments, each frame 52 is constructed of either non-oxidizing metal or plastic tubing or piping with a hollow interior, and acts as the conduit of water to the misting nozzles 1. If the frame 52 is constructed of an oxidizing metal the interior and exterior are coated with a non-oxidizing lining to prevent rusting. One frame 52 has a water port 9 connectable to a water source 10 to introduce water into the interior of the frame 52. In such embodiments, the frames 52 may be connected by rubber or plastic tubing that allow water to flow between each frame 52. In such embodiment, no separate supply line is used to conduct the water.

Figure 13:
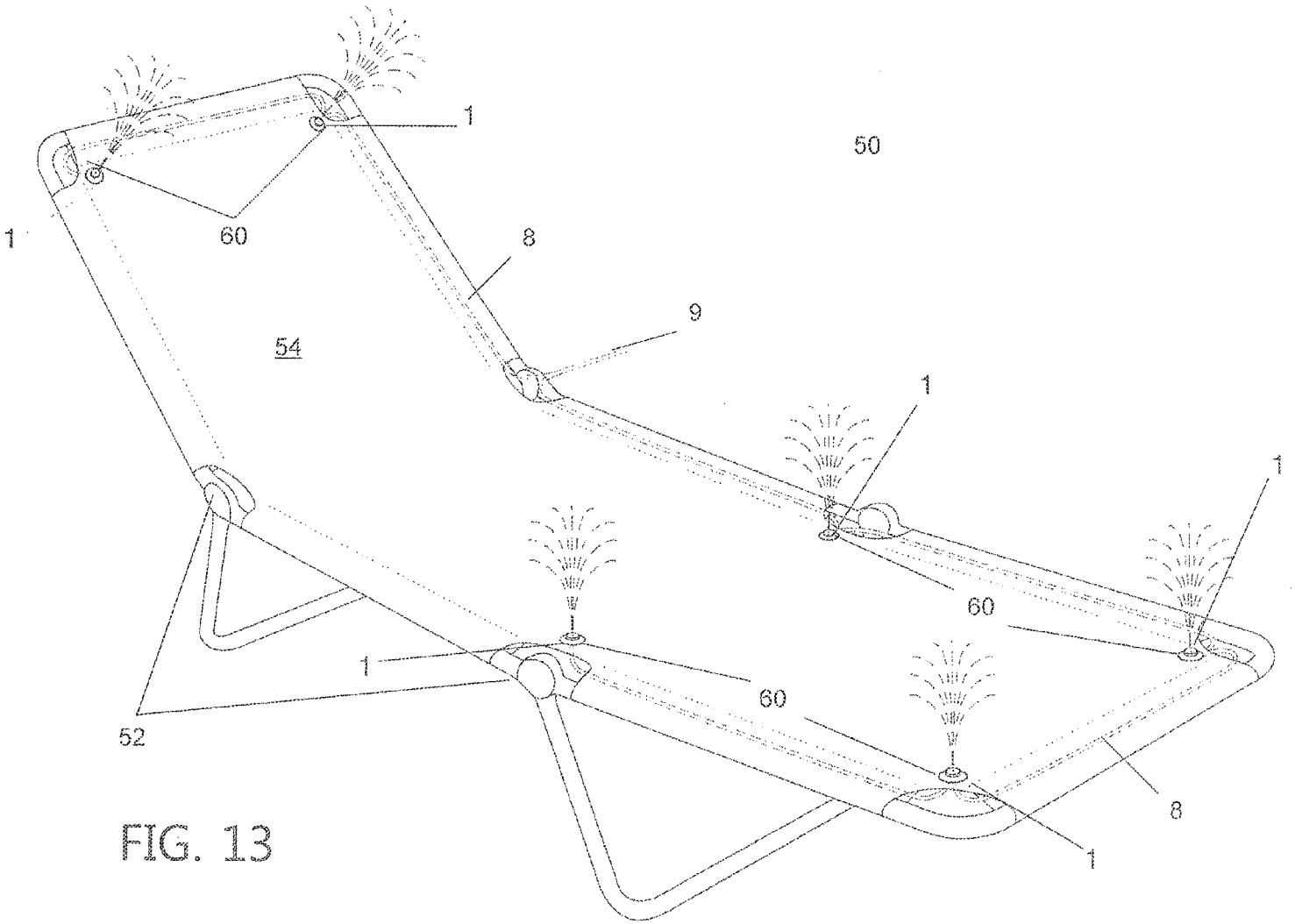
FIG. 13 shows a perspective view of another embodiment of a misting chair in accordance with the present invention.

FIG. 13 depicts another embodiment of a lounge 50 in accordance with the present invention. In this embodiment, the misting nozzles 1 are dispersed about the perimeter of the lounge 50 and pass through the fabric, weave, or lining of the backing material 54 of the lounge 50. In this embodiment, the misting nozzles 1 are not attached to, but rather are separate from, the frame 52. The misting nozzles 1 are dispersed along the topside and around the perimeter of the backing material 54. To situate the misting nozzle 1 in the backing material 54, a grommet 60 passes through the backing material 54, and the misting nozzle 1 is secured in and through the grommet 60. The body of the misting nozzle 1 is exposed along the underside of the backing material 54.

As with the other embodiments, the misting nozzles 1 are grouped into at least two zones 58, such that each zone 58 has at least one misting nozzle 1. The misting nozzles 1 in each zone 58 are configured to spray mist over or in the vicinity of the lounge 50 defined by the zone 58. In this manner, each zone 58 of the lounge 50 is covered by an independent set of one or more misting nozzles 1. For example, a lounge 50 may be characterized by three zones 58 of one or more misting nozzles 1 in each zone 58, where the misting nozzles 1 in each zone 58 are independently directed to spray mist substantially over the upper, middle, and lower frames 52, respectively. The misting nozzles 1 are supplied water from a supply line 8. The supply line 8 has a water port 9 attachable to a water source 10 that provides water.

A user can control the flow rate of water through the misting nozzles 1 of each zone 58 by a valve 2, such that the flow of water can be turned on or shut off through a given zone 58 independently of the flow of water through the other zones 58. Each valve 2 is in fluid connection with the supply line 8 and may be physically attached to the frame 52. The valve 2 may be located along the supply line 8 to regulate the water flow provided to the zone 58 that it governs. Any valve 2 operable to control the flow of water, including those described with reference to FIGS. 2-5 above, may be used. In embodiments in which a zone 58 has a single misting nozzle 1, the misting nozzle 1 may be embedded within the valve head 3, as depicted in and discussed with reference to FIGS. 4-5 above.

Figure 14:
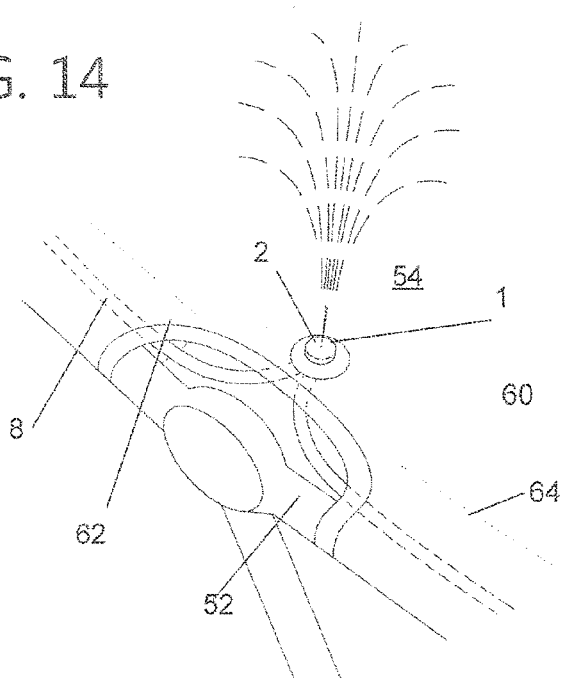
FIG. 14 shows a close up view of a misting nozzle inserted through the chair fabric of the embodiment of FIG. 13, in accordance with one embodiment of the present invention.

FIG. 14 depicts a close-up view of one misting nozzle 1 and the supply line 8 providing water. The misting nozzle 1, which passes through the grommet 60, is secured to the backing material 54 by being situated in the grommet 60. The misting nozzle 1 is situated in the grommet 60 by screwing or threading the bottom of the misting nozzle 1 into the open end of the water supply line 8. Alternatively, the misting nozzle 1 may have a barbed bottom (not shown) which may be forced through the grommet 60 and then inserted into the open end of the water supply line 8. The barb then locks the misting nozzle into the grommet 60.

The grommet 60 passes through the backing material 54 beyond the seam 64 that forms a pocket 62. The supply line 8 passes through the pocket 62 formed by wrapping the backing material 54 around the frame 52. As the supply line 8 approaches the misting nozzle 1, the supply line 8 exits the pocket 62 and connects to the misting nozzle 1 to provide water. The supply line 8 then passes back through the pocket 62 to the next misting nozzle 1. In the embodiment depicted, the misting nozzle 1 is located near a joint where a leg 56 attaches. In these locations, the backing material 54 may be pulled back from the frame 52 to avoid catching on the leg or joint as the lounge 50 is folded together or unfolded for use. Thus, the supply line 8 may simply exit the pocket 62 where the backing material 54 pulls away from the frame 52, supply water to the misting nozzle 1, and then re-enter the pocket 62. In other embodiments where the pocket 62 is continuous, the supply line 8 may enter and exit the pocket 62 through a small hole or opening.

Figure 15:
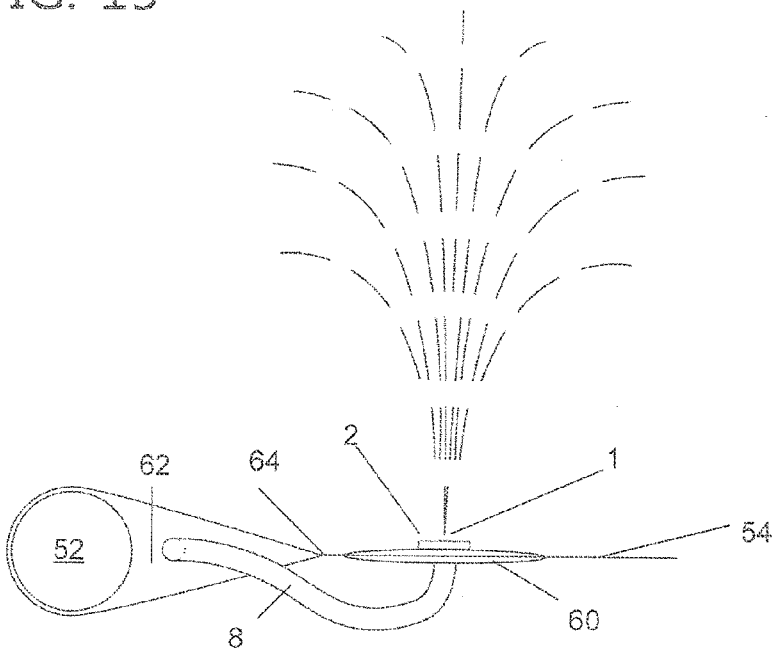
FIG. 15 shows a cross-section view of the misting nozzle inserted through the chair fabric, in accordance with one embodiment of the invention.

FIG. 15 is a cross-section view showing the misting nozzle 1 next to the pocket 62. As can be seen, the pocket is formed by wrapping the backing material 54 around the frame 52 and then attaching the edge of the backing material 54 to the body of the material to form a seam 64. The grommet 60 is positioned next to the seam 64, and the misting nozzle 1 passes through the grommet 60. The supply line 8 passes out from the pocket 62 to provide water to the misting nozzle 1.

In other embodiments, the grommet 60 may be located within the pocket 62, such that the misting nozzle 1 inserts into the pocket 62. In such an embodiment, the supply line 8 does not have to enter or exit the pocket 62 to supply water to the misting nozzle 1.

Although the embodiment depicted in FIGS. 13-15 shows a grommet 60 securing the misting nozzle 1, such a grommet 60 is not necessary in all embodiments. For example, the misting nozzle 1 may have a barbed or bulbous end for puncturing through the backing material 54 to connect to the supply line 8. The barb or bulbous end then secures the misting nozzle 1 within the backing material 54 without the use of a grommet 60.

While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. A lounge chair for providing mist to a user comprising:

at least one leg;

a frame supported by the at least one leg and comprising a left side, a right side, an upper portion configured to support the user's head and upper body, a middle portion configured to support the user's hips and abdomen, and a lower portion configured to support the user's legs and feet;

a backing material covering the frame and comprising a bottom surface confronting the frame and a top surface, the backing material comprising a plurality of grommet holes;

an upper misting zone comprising a left upper misting nozzle and a right upper misting nozzle, the left and right upper misting nozzles each configured to spray water in the form of a mist to the user's head and upper body, and an upper water supply line configured to supply water to the left and right upper misting nozzles;

a middle misting zone comprising a left middle misting nozzle and a right middle misting nozzle, the left and right middle misting nozzles each configured to spray water in the form of a mist to the user's hips and abdomen, and a middle water supply line configured to supply water to the left and right middle misting nozzles;

a lower misting zone comprising a left lower misting nozzle and a right lower misting nozzle, the left and right lower misting nozzles each configured to spray water in the form of a mist to the user's legs and feet, and a lower water supply line configured to supply water to the left and right lower misting nozzles;

a water port configured to connect to a water supply, the water port configured to supply water to the upper, middle and lower misting zones;

a first control valve having an open position in which the first control valve permits water to flow through the upper water supply line and exit the left and right upper misting nozzles and a closed position in which the first control valve prevents water from flowing through the upper water supply line and exiting the left and right upper misting nozzles;

a second control valve having an open position in which the second control valve permits water to flow through the middle water supply line and exit the left and right middle misting nozzles and a closed position in which the second control valve prevents water from flowing through the middle water supply line and exiting the left and right middle misting nozzles, the second control valve distinct from the first control valve; and a third control valve having an open position in which the third control valve permits water to flow through the lower water supply line and exit the left and right lower misting nozzles and a closed position in which the third control valve prevents water from flowing through the lower water supply line and exiting the left and right lower misting nozzles, the third control valve distinct from the first control valve and the second control valve;

wherein all of the misting nozzles are configured to spray water in the form of a mist away from the backing material, and further wherein each misting nozzle is substantially co-planar with the top surface of the backing material and located in a grommet hole.

2. The lounge chair of claim 1 wherein all of the misting nozzles are configured to spray water perpendicular to the top surface of the backing material.

3. The lounge chair of claim 1 wherein the backing material comprises at least one pad.

4. The lounge chair of claim 1 wherein the first, second and third valves are located along the left side of the lounge chair.

5. The lounge chair of claim 1 wherein the first, second and third valves are located along the right side of the lounge chair.

6. The lounge chair of claim 1, where the misting nozzles in each zone are oriented to spray mist over an area substantially independent from areas sprayed by the misting nozzles in the other zones.

7. The lounge chair of claim 1 wherein the first, second and third control valves are rotatable by the user.

8. The lounge chair of claim 1 wherein the left and right upper misting nozzles, the left and right middle misting nozzles and the left and right lower misting nozzles are the only misting nozzles on the lounge chair.

9. The lounge chair of claim 1 wherein the backing material is comprised of fabric.

* * * * *